US011279004B1

(12) United States Patent
Ezra

(10) Patent No.: US 11,279,004 B1
(45) Date of Patent: Mar. 22, 2022

(54) SWIVEL WHEEL SPINDLE HOUSING CLAMP

(71) Applicant: Leslie P Ezra, Winamac, IN (US)

(72) Inventor: Leslie P Ezra, Winamac, IN (US)

( * ) Notice: Subject to any disclaimer, the term of this patent is extended or adjusted under 35 U.S.C. 154(b) by 276 days.

(21) Appl. No.: 16/692,535

(22) Filed: Nov. 22, 2019

(51) Int. Cl.
*B25B 5/00* (2006.01)
*B25B 5/14* (2006.01)

(52) U.S. Cl.
CPC ..... *B25B 5/14* (2013.01)

(58) Field of Classification Search
CPC .. B25B 5/00; B25B 5/14; B25B 5/067; B25B 5/082; B25B 5/101
See application file for complete search history.

(56) References Cited

U.S. PATENT DOCUMENTS 3,556,328 A * 1/1971 Miles ..... B66F 9/149 414/607
4,828,241 A * 5/1989 Yang ..... B25B 5/003 269/114
5,312,097 A * 5/1994 Womack ..... B25B 5/003 269/139
5,513,838 A * 5/1996 Van Rossum ..... B25B 5/003 269/203
8,342,540 B1 * 1/2013 Marleau ..... E01H 5/063 280/5.513

* cited by examiner

*Primary Examiner* — Lee D Wilson

(57) ABSTRACT

Swivel wheel spindle housing clamps provide an easy way, without drilling holes, to attach a steel rectangular horizontal tube across a front of zero turn lawn mowers. The clamps fasten to a spindle housing by tightening two set screw bolts of the clamp against one side of the spindle housing. The same spindle housing clamp fits both left spindle housing and the right spindle housing of the lawn mowers. The clamps fit small to large spindle housings. A pair of housing clamps can remain on the zero turn lawn mower all year long and not inhibit normal use. Carriage bolts and large, rubber coated, threaded knobs are provided so wrenches are not needed to lock the rectangular steel tube inside the pair of housing clamps. The rectangular steel horizontal tube can support a variety of useful attachments, including a ball hitch, a carrier platform, a snow blade, a leaf rake, or other useful devices.

5 Claims, 5 Drawing Sheets

SWIVEL WHEEL SPINDLE HOUSING CLAMP

FIELD OF INVENTION

This application relates to a new and useful housing clamp, moreover a device, attached to a common location on zero turn lawn mowers, to fasten a variety of steel tubes allowing a connection for many useful attachments.

BACKGROUND

Zero turn lawn mowers have become very popular with home owners and commercial lawn mowing companies. The manufacturers build zero turn lawn mowers with plenty of horsepower and traction, yet seldom provide a hitch or other means to hook up useful attachments. A clamp that could be attached to a common place on zero turn lawn mowers would be very helpful in fastening attachments to said mowers. Swivel wheel spindle housing clamps provide a simple way to connect attachments to zero turn lawn mowers.

A pair of swivel wheels is common on zero turn lawn mowers. Each swivel wheel spindle rotates inside a cylinder shaped steel housing. A left front portion and a right front portion of zero turn lawn mower frames are welded to a backside of each spindle housing, leaving over one half of said housing available for an addition of spindle housing clamps.

Swivel wheel spindle housing clamps grasp firmly onto each spindle housing. A long rectangular steel tube is mounted across a front of said mower as said steel tube is locked inside both spindle housing clamps. Together, both clamps support said steel tube. Said rectangular steel tube can now support a variety of useful attachments.

Said rectangular steel tube, with a hitch ball attached, can be mounted to said clamps, thus providing an operator with a vehicle that can easily maneuver a trailer into a tight space. Another rectangular steel tube, with a carrier platform attached, and mounted to said clamps, provides a means for hauling various items. Still, another rectangular steel tube, with a snow blade attached, allows for removal of snow, dirt, sand, rocks, or other objects from unwanted areas. Also, another rectangular steel tube, with a leaf rake attached, allows for quick movement of leaves, small sticks or twigs, dead grass, or other items.

Various rectangular steel tubes with a variety of attachments can be fastened to a pair of swivel wheel spindle housing clamps without the use of any tools. A carriage bolt with a spin-on, rubber coated, plastic knob is used to squeeze together each plate of said housing clamp, and thus securing said rectangular steel tube between each said plate.

Swivel wheel spindle housings are typically welded to front ends of zero turn lawnmower frames. Since the front ends of zero turn lawnmower frames are manufactured at various angles, swivel wheel spindle housing clamps are designed to be mounted at various angles. Three examples of said clamps mounted at various angles are shown in FIG. 3. Each upper and lower plate, of said clamp, has several pairs of vertically aligned square holes, thus allowing a carriage bolt to be inserted through at least one pair of said square holes and clearing a rectangular steel tube positioned in between each clamp. Said rectangular steel tube can then be secured by tightening a rubber coated plastic threaded knob onto said carriage bolt. Examples of square holes are shown in FIG. 3, FIG. 4, and FIG. 5. Said clamp can be mounted to either a left front spindle housing or a right front spindle housing. With the use of spindle housing clamps, said rectangular steel tubes, with selected attachment, can now be quickly added to or removed from said lawn mowers, without the use of tools.

Light duty zero turn lawn mowers have small diameter spindle housings. Heavy duty zero turn lawn mowers have larger diameter spindle housings. Each said clamp has a semicircular opening that fits a range of small to large spindle housings. Swivel wheel spindle housing clamps are fixed to said spindle housings by tightening two fully threaded set screw bolts on each clamp. Said clamps can be left on said spindle housings of lawn mowers all year long. Mounted swivel wheel spindle housing clamps do not interfere with every day use of said lawn mowers.

References Cited [Referenced By]
U. S. Pat. Documents

| | | |
|---|---|---|
| 3599996 | August 1971 | Holt |
| 3790182 | February 1974 | Schumann |
| 3999769 | December 1976 | Bayer |
| 4075927 | February 1978 | Frazier |
| 4135848 | January 1979 | Hughes |
| 4412767 | November 1983 | Schmid |
| 4727702 | March 1988 | Keim |
| 4850734 | July 1989 | Naumec |
| 5511801 | April 1996 | Kanaan |
| 5730563 | March 1998 | Matsumoto |
| 6234731 | May 2001 | Sakamoto |
| 6287059 | September 2001 | Hashidate |
| 6675683 | January 2004 | Tsai |
| 6860683 | March 2005 | Choi |
| 6929437 | August 2005 | Ammann |
| 7195431 | March 2007 | Greif |
| 7247919 | July 2007 | Dawidziak |
| 7281331 | October 2007 | Stutsman |
| 7318692 | January 2008 | Herla |
| 7331585 | February 2008 | Lindstrom |
| 7367097 | May 2008 | Nakamura |
| 7393165 | July 2007 | Greif |
| 7543394 | June 2009 | Enderle |
| 8088456 | November 2011 | Mohr |
| 8376670 | February 2013 | Shinano |
| 8403338 | March 2013 | Hainer |
| 8556554 | October 2013 | Hangleiter |
| 8585333 | November 2013 | Feldmeier |
| 8814769 | August 2014 | Fujioka |
| 8911187 | December 2014 | Cornish |
| 8998545 | April 2015 | Stoneback |
| 9387539 | July 2016 | Hangleiter |
| 9527136 | December 2016 | Buschbeck |
| 9545699 | January 2017 | Furusawa |
| 9694472 | July 2017 | Luescher |
| 9707376 | July 2017 | Smith |
| 9956621 | May 2018 | Haimer |
| 10004876 | June 2018 | Smith |
| 10016867 | July 2018 | Stoneback |
| 10058927 | August 2018 | Mihailovic |
| 10065287 | September 2018 | Stra |
| 10259090 | April 2019 | Van Sprang |
| 10369634 | August 2019 | Kitamura |
| 10435895 | October 2018 | Grumberg |
| 20180354042 | December 2018 | Kitamura |
| 20180361612 | December 2018 | Wang |
| 20180369923 | December 2018 | Chen |
| 20190081469 | March 2019 | Shea |
| 20190086007 | March 2019 | Ahrens |
| 20190100150 | April 2019 | McFadden |
| 20190133421 | May 2019 | Golden |
| 20190145558 | May 2019 | Cowham |
| 20190154066 | May 2019 | Fletcher |
| 20190162338 | May 2019 | Kaelsen |
| 20190170273 | June 2019 | May |
| 20190183531 | June 2019 | Miller |
| 20190186162 | June 2019 | Whittemore |
| 20190195252 | June 2019 | Pryor |
| 20190209193 | July 2019 | Bazan Alvarez |

-continued

| References Cited [Referenced By] U. S. Pat. Documents | | |
|---|---|---|
| 20190211858 | July 2019 | Nehls |
| 20190211953 | July 2019 | Leebych |
| 20190211954 | July 2019 | Green |
| 20190217447 | July 2019 | Wang |
| 20190217786 | July 2019 | Sautter |

The prior is well documented with various clamps used in many different situations.

Patent No. 20190217786, July 2019, to Sautter describes a crossbar clamp device for connecting cargo-specific assemblies to a crossbar on vehicles.

Patent No. 20190217447, July 2019, to Wang uses an F-type clamp with an anti-pivot and lock mechanism that engages a post.

Patent No. 20190211858, July 2019, to Nehls uses a rotatable beam clamp.

Patent No. 20190195252, June 2019, to Pryor uses a clamp for mounting a structure on a support.

Patent No. 20190186162, June 2019, to Whittemore describes a pole clamp system.

Patent No. 20190183531, June 2019, to Miller describes a clamping device of an external fixation system with a jaw set and a slider.

Patent No. 20190162338, May 2019, to Karlsen uses a subsea clamp connection for connecting the ends of two tubular members.

Patent No. 20190154066, May 2019, to Fletcher describes a clamping system to secure objects or accessories to vehicles.

Patent No, 20190100150, April; 2019, to McFadden uses a crossbar clamp for a crossbar-to-vehicle coupler.

U.S. Pat. No. 10,058,927, August 2018, to Mihailovic applies to a spindle clamp for a milling machine or heavy duty drill press. A tool being held would be a drill bit or an end mill cutting tool with a round bar like shank, and not a tool bar.

The clamp appears to require a pair of recessed holes in a spindle housing to assure extreme holding power by locking into said holes.

U.S. Pat. No. 9,545,699, January 2017, to Furusawa uses a work tool with spindle and clamp shaft with a flange.

U.S. Pat. No. 9,387,539, July 2016, to Hangleiter uses a gripper with an emergency release.

U.S. Pat. No. 8,911,187, December 2014, to Cornish uses an adjustable radius and angle coping device.

U.S. Pat. No. 8,066,456, November 2011, to Mohr uses a clamping device.

U.S. Pat. No. 7,318,692, January 2008, to Herla uses a spindle with tool ejection feature.

U.S. Pat. No. 7,249,919, July 2007, to Dawidziak uses a release device for activating a clamping device for tools.

U.S. Pat. No. 6,929,437, August 2005, to Ammann uses a spindle with axially acting collet opening device.

U.S. Pat. No. 6,675,683, January 2004; to Tsai uses a cutter releasing mechanism for direct connect spindles.

SUMMARY OF INVENTION

Zero turn lawnmowers are very maneuverable and have plenty of horsepower and traction. Said lawn mowers are very capable of performing a variety of needed tasks. The addition of swivel wheel spindle housing clamps, and secured rectangular steel tube, will allow said lawn mowers to support a variety of attachments. Said clamps, attach to a common place on said mowers, together with said steel tube, accomplish such support. Attachments to said steel tubes, such as a hitch ball, a carrier platform, a snow blade, a lead rake, and other useful devices, provide zero turn lawn mowers with easy access to useful equipment for accomplishing various tasks.

BRIEF DESCRIPTION OF DRAWINGS

FIG. 5 also shows a rectangular steel tube (500) fastened to said spindle housing clamps. Also shown in FIG. 5 is a semi circular shaped hitch plate (800) welded near a middle of said rectangular tube. Additionally, said plate is shown with a hitch ball (200) bolted onto said plate.

FIG. 6 also shows a rectangular steel tube (500) fastened to said spindle housing clamps. Also shown in FIG. 6 is a semi circular shaped hitch plate (800) welded near a middle of said rectangular tube. Additionally, said plate is shown with a hitch ball (200) bolted onto said plate.

FIG. 7 also shows a rectangular steel tube (500) fastened to said spindle housing clamps. Also shown in FIG. 7 is a semi circular shaped hitch plate (800) welded near a middle of said rectangular tube. Additionally, said plate is shown with a hitch ball (200) bolted onto said plate.

DETAILED DESCRIPTION OF DRAWINGS

Figure 1:
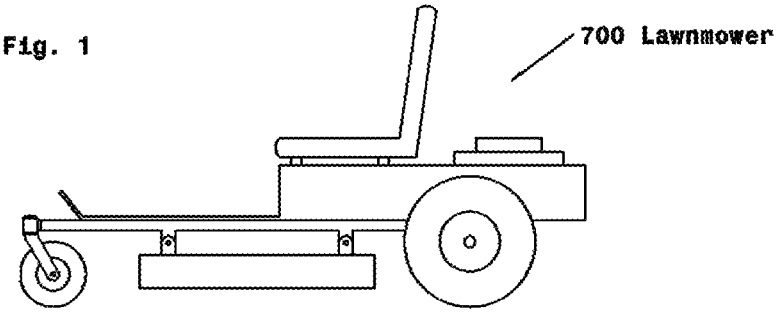
FIG. 1 shows prior art of a side view of a zero turn lawnmower (700) without any attachments.

FIG. 1 shows a side view of a zero turn lawnmower before adding any attachments.

Figure 2:
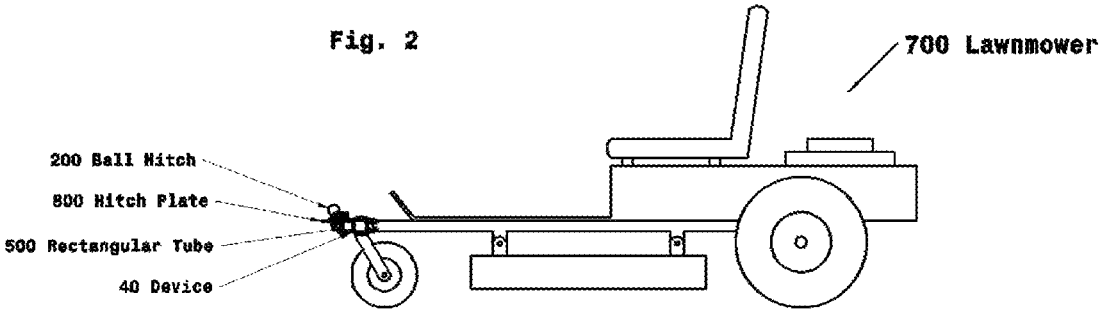
PRIOR ART Fig. 2
FIG. 2 shows a side view of a zero turn lawnmower (700) with swivel wheel spindle housing clamps (40) installed on spindle housings at a front end of the lawnmower frame. A hitch ball (200) is shown mounted to a hitch plate (800), welded to a rectangular tube (500).

FIG. 2 shows a side view of a zero turn lawnmower with swivel wheel spindle housing clamps installed on spindle housings at a front end of said lawnmower frame. A rectangular steel tube is mounted inside said housing clamps. A steel plate is welded to said rectangular steel tube. A ball hitch is bolted through a hole in said steel plate.

Figure 3:
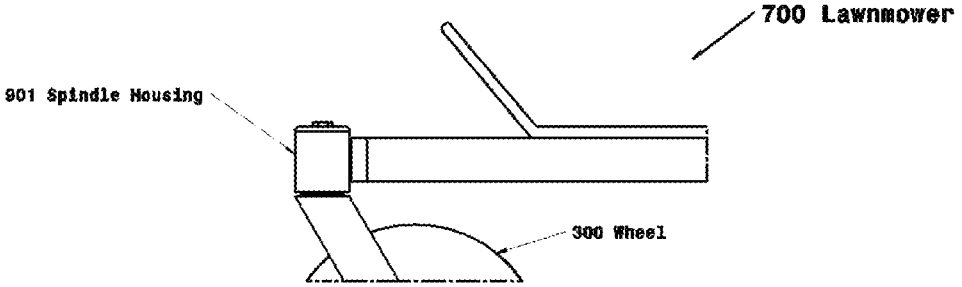
FIG. 3 shows prior art of a swivel wheel spindle housing (901) on a lawn mower (700) with no spindle housing clamp attached. Wheel (300) is shown.

FIG. 3 shows a swivel wheel spindle housing with no housing clamp attached.

Figure 4:
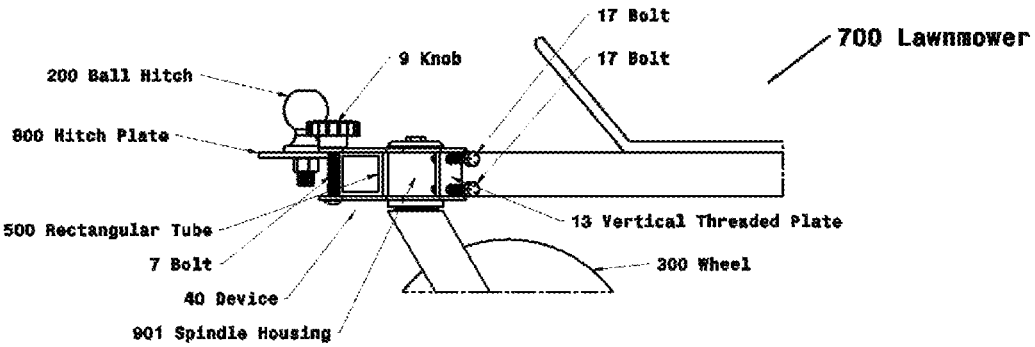
PRIOR ART Fig. 4
FIG. 4 shows a swivel wheel spindle housing (901) on a lawn mower (700) with a housing clamp (40) attached. A rectangular steel tube (500) is shown mounted inside said housing clamp. Said rectangular tube has a hitch ball (200) mounted to a hitch plate (800), previously welded to said tube. Wheel (300) is shown.

FIG. 4 shows a swivel wheel spindle housing with a housing clamp attached. Two set screw bolts are screwed through a thick vertical side plate. Said set screw bolts are tightened until they secure said housing clamp firmly onto the spindle housing. A rectangular steel tube is shown mounted inside a pair of housing clamps. A carriage bolt is shown inserted vertically from a bottom side of said clamp. A plastic threaded knob is shown screwed onto said carriage bolt. Said plastic knob is hand tightened until said rectangular steel tube is secured within said plates of said clamp. A hitch ball is shown mounted by a threaded bolt through a steel plate, previously welded to said rectangular tube.

Figure 5:
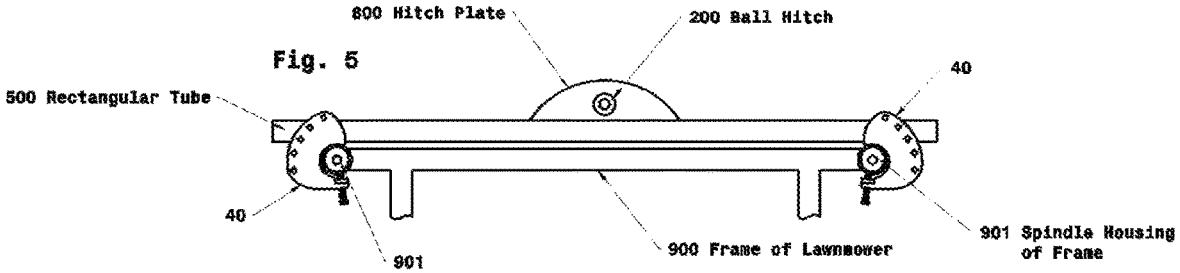
FIG. 5 shows a top view of a swivel wheel spindle housing clamps (40) fastened to spindle housings (901) of straight frame (900).

FIG. 5 shows swivel wheel spindle housing clamps fastened to spindle housings that have been welded to a left front end and a right front end of straight frame cross tubes. Said clamps are locked onto both right spindle housing and left spindle housing. Said clamps are mounted to spindle housings at various angles allowing a rectangular steel tube to be mounted inside said clamps. A most inward pair of vertically aligned square holes, in a top plate and a bottom plate, is used to secure said tube by using two carriage bolts and threaded knobs. A semi circular shaped steel plate is also shown welded to a middle of said steel tube. Furthermore, a hitch ball is shown bolted through said plate.

Figure 6:
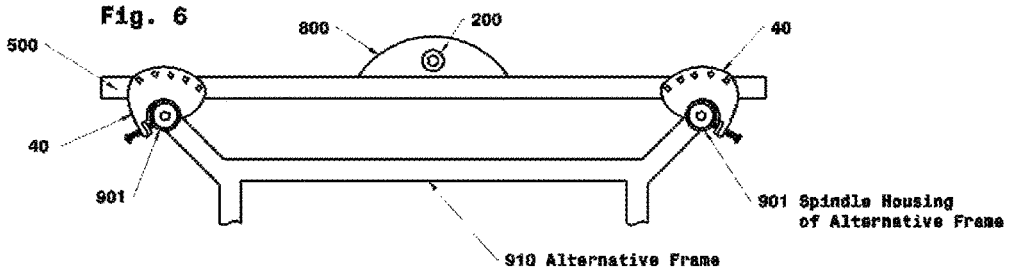
FIG. 6 shows a too view of swivel wheel spindle housing clamps (40) fastened to spindle housings (901) of 45 degree angle alternate frame (910).

FIG. 6 shows swivel wheel spindle housing clamps fastened to spindle housings that have been welded to a left front end and a right front end of 45 degree angle cross tubes. Said clamps are locked onto both right spindle housing and left spindle housing. Said clamps are mounted to spindle housings at various angles allowing a rectangular steel tube to be mounted inside said clamps. An appropriate pair of vertically aligned square holes, in top and bottom plate, is used to secure a rectangular steel tube using two carriage bolts and threaded knobs. A semi circular shaped steel plate is also shown welded to a middle of said steel tube. Furthermore, a hitch ball is shown bolted through said plate.

Figure 7:
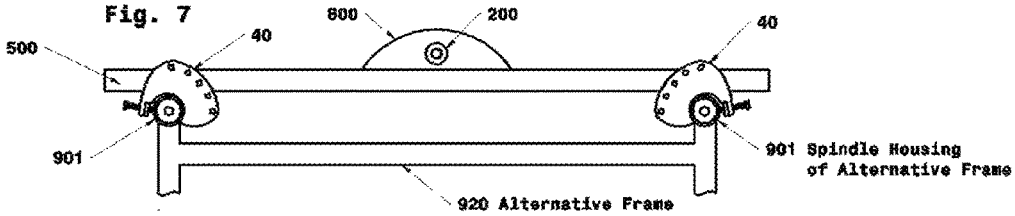
FIG. 7 shows a too view of swivel wheel spindle housing clamps (40) fastened to spindle housings (91) of parallel alternate frame (920).

FIG. 7 shows swivel wheel spindle housing clamps fastened to spindle housings that have been welded at a left front end and right front end of parallel frame cross tubes. Said clamps are locked onto both right spindle housing and left spindle housing. Said clamps are mounted to spindle housings at various angles allowing a rectangular steel tube to be mounted inside said clamps. A most outward pair of vertically aligned square holes, in top and bottom plate, is used to secure a rectangular steel tube using carriage bolts and threaded knobs. A semi circular shaped steel plate is also shown welded to a middle of said steel tube. Furthermore, a hitch ball is shown bolted through said plate.

Figure 8:
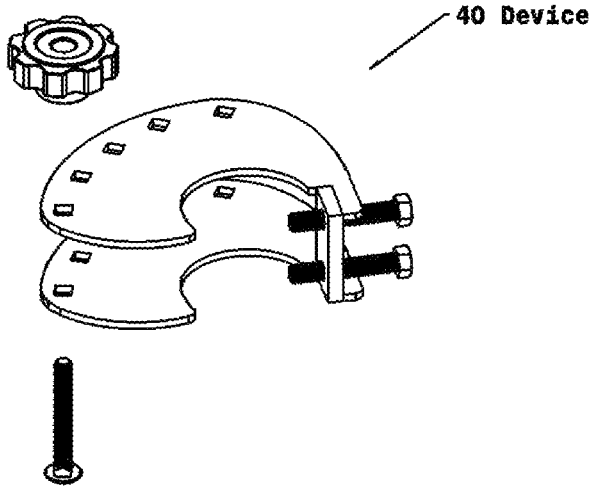
FIG. 8 shows a three dimensional view of a complete swivel wheel spindle housing clamp (40).

FIG. 8 shows a 3 dimensional view of a complete swivel wheel spindle housing clamp. Said clamp has a top plate and a bottom plate that are welded at one end to a vertical thick plate. Said vertical plate has two threaded holes. Threaded set screw bolts are screwed into said threaded holes. Said set screws are to be tightened with a wrench until said clamp firmly grips a steel spindle housing. Both plates are identical and have several square holes. A carriage bolt is shown, ready to be vertically inserted upward, through one set of said square holes. A rubber coated plastic threaded knob, to be hand threaded onto said carriage bolt, is also shown. Both plates can flex and squeeze a rectangular steel tube when said plastic knob is hand tightened.

Figure 9:
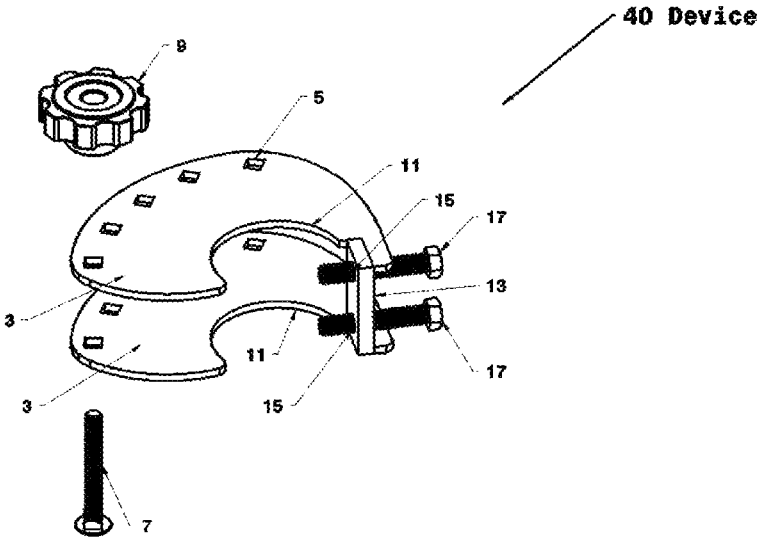
FIG. 9 shows a three dimensional view of a complete swivel wheel spindle housing clamp (40) comprising; plates (3) with semicircular shaped edges (11), square holes (5), threaded carriage bolt (7), rubber coated plastic threaded knob (9), thick plate (13), threaded holes (15), and fully threaded bolts (17).

FIG. 9 shows a three dimensional view of a complete swivel wheel spindle housing clamp. A top plate #3 and a bottom plate #3 have several evenly spaced square holes #5. A threaded carriage bolt #7, inserted vertically upward through one set of square holes #5, secures a rectangular steel tube, between said top and bottom plates, when rubber coated plastic threaded knob #9 is hand tightened onto said carriage bolt #7. Both identical plates #3 have an inside curve shaped edge #11. On a back side of a vertical rectangular thick plate #13, near a top edge, and also near a bottom edge, are welded plates #3. Said welds are near one end of said curve shaped edges #11. Said vertical thick plate #13 has two threaded holes #15. Two fully threaded bolts #17 are each screwed into a different threaded hole #15.

CONCLUSION

A pair of swivel wheels is common on zero turn lawn mowers. Each swivel wheel spindle rotates inside a cylinder shaped steel housing A clamp that could be secured to a common place on zero turn lawn mowers would be very helpful in fastening attachments to said mowers. Swivel wheel spindle housing clamps provide a simple way to connect attachments to zero turn lawn mowers. Said clamps, secured to a common location on zero turn lawn mowers, can fasten a variety of steel tubes, allowing a connection for many useful attachments. Swivel wheel spindle housings are typically welded to front ends of zero turn lawnmower frames. Each upper and lower plate of said clamp has several square holes to insure a carriage bolt can be inserted through at least one set of square holes allowing said bolt to clear said rectangular steel tube. Swivel wheel spindle housing clamps are fixed to said spindle housings by tightening two fully threaded set screw bolts on each clamp. Mounted swivel wheel spindle housing clamps do not interfere with every day use of said lawn mowers. Each said clamp has a semicircular opening that fits a range of small to large spindle housings. Attachments such as a hitch ball, carrier platform, snow blade, leaf rake, and other useful devices, provide zero turn lawn mowers with easy access to equipment useful for accomplishing various tasks.

What is claimed:

1. A swivel wheel spindle housing clamp that attaches a cylindrical steel vertical housing, containing bearings for a swivel wheel spindle commonly found on zero turn lawn mowers, to a rectangular metal horizontal tube supporting various attachments, said clamp comprising:

a top and bottom plate having a semicircular shape wherein said top and bottom plates include a plurality of square holes aligned arcuately being parallel with respect to said top and bottom plates with said plurality of hole being evenly spaced apart;

a vertical plate comprising threaded holes being connected to said top and bottom plates and positioned substantially angular to said top and bottom plates;

at least one fastening mechanism being attached to said vertical plate;

a knob and fastening mechanism being connected together and removably attachable to said top and bottom plates.

2. The swivel wheel spindle housing clamp of claim 1, wherein said at least one fastening mechanism or plurality of said fastening mechanisms are threaded bolts being connected to the threaded holes of said vertical plate.

3. The swivel wheel spindle housing clamp of claim 1, wherein said knob and fastening mechanism has a fastening mechanism including a square member on a head of said fastening mechanism which locks in said square holes of said top and bottom plates.

4. The swivel wheel spindle housing clamp of claim 1, wherein said top and bottom plates include an arcuate inner surface with a hook at a distal end of said top and bottom plates which is distal from said vertical plate which is connected to a proximal end of said top and bottom plates.

5. The swivel wheel spindle housing clamp of claim 1, wherein said top and bottom plates include a straight edge on a distal end of an arcuate outer surface of said arcuate top and bottom plates.

* * * * *